US007167827B2

(12) United States Patent
Conrad

(10) Patent No.: US 7,167,827 B2
(45) Date of Patent: Jan. 23, 2007

(54) AUDIO INFORMATION LEAFLET SYSTEM

(75) Inventor: Terry Conrad, San Diego, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 10/522,460

(22) PCT Filed: Jul. 25, 2003

(86) PCT No.: PCT/US03/23164

§ 371 (c)(1),
(2), (4) Date: Jan. 25, 2005

(87) PCT Pub. No.: WO2004/012377

PCT Pub. Date: Feb. 5, 2004

(65) Prior Publication Data

US 2005/0216108 A1 Sep. 29, 2005

(51) Int. Cl.
*G10L 21/00* (2006.01)

(52) U.S. Cl. ..... 704/206; 40/124.03

(58) Field of Classification Search ..... 700/90; 40/124.04, 124.03; 704/201, 203, 206, 208; 455/414.4

See application file for complete search history.

(56) References Cited

U.S. PATENT DOCUMENTS 4,531,310 A 7/1985 Acson et al.
4,611,262 A 9/1986 Galloway et al.
5,063,698 A 11/1991 Johnson et al.
5,270,922 A * 12/1993 Higgins ..... 705/37
5,275,285 A 1/1994 Clegg
5,796,328 A * 8/1998 Golant ..... 340/384.1
5,860,065 A 1/1999 Hsu
6,104,306 A * 8/2000 Hogue et al. ..... 340/686.1
6,359,991 B1 3/2002 Azima et al.
6,675,511 B1 * 1/2004 Pines ..... 40/124.03
7,092,898 B1 * 8/2006 Mattick et al. ..... 705/26

* cited by examiner

*Primary Examiner*—Albert W. Paladini
(74) *Attorney, Agent, or Firm*—Thorpe North & Western LLP

(57) ABSTRACT

A method for the dissemination of audio information in a hostile environment via an airdrop to mainly illiterate populations in a target area by means of a leaflet (10, 14) containing audio circuitry (12). In the first step (1) the hostile target population is identified and the desired content of the audio information is selected. In the next steps, hardened, waterproof audio leaflets (10, 14) are manufactured (2) and recorded (4), (5) with the desired audio information. Finally, the audio leaflets are then airdropped (6) to the target population. The audio message is played (7) when the leaflet is activated by a member of the target population. The method is practiced using an audio leaflet designed to play an audio message. The leaflet (10, 14) is embodied in a protective structure capable of surviving (i) an impact resulting from and airdrop and (ii) extended exposure to adverse elements of nature for at least three days. A memory circuit (12) is contained within the leaflet and is capable of storing at least one audio message. The leaflet may include a lightweight speaker, a power source and an activating switch coupled to the memory circuit, as well as an audio playback circuit coupled to the memory circuit to play the at least one audio message from the lightweight speaker.

24 Claims, 4 Drawing Sheets

AUDIO INFORMATION LEAFLET SYSTEM

BACKGROUND OF THE INVENTION

1. Field of the Invention

The present invention relates generally to psychological and informational operations supporting military campaigns. More particularly, the present invention relates to targeted audio information dissemination.

2. Related Art

Psychological and informational operations play a major role in a majority of U.S. military actions, many of them focused on target countries where the population is often illiterate and adverse in interest to the U.S. The dissemination of specially selected information concerning U.S. involvement in the conflict and the nature of the opposing party can act to increase the efficiency of the military action by altering the local support from the general population, thus hastening the end to the conflict and ultimately saving lives. One of the reasons why psychological and informational operations play a major role in these situations is because they can impact the mental state of the population in the target country thus demoralizing them and reducing their support to the enemy military. Alternatively, information disseminated to the population targeting injustices perpetrated by the opposing side can cause the population to rally in support of the U.S. forces, again causing reduced support to the opposing military. These operations have traditionally been implemented through the use of radio broadcasts and dropping printed leaflets from airplanes, both passively and with the use of "leaflet bombs."

One major issue concerning the dissemination of information in these psychological and informational operations pertains to the literacy and the economic condition of the recipients. In many areas of the world where conflicts arise, a large portion of the population is illiterate and very poor. Radio broadcasts are generally ineffective in these locations because of the low numbers of radio receivers owned by individuals in the population. Additionally, those individuals that do possess radios must have them tuned to the correct frequency to allow reception of the message during the broadcast. And once the message has been broadcast, its informational value is gone, thus further decreasing the effectiveness of the dissemination of information.

Leaflets printed with the information to be disseminated have many advantages over radio. They are cheap to print and can be distributed over large areas to many individuals regardless of their economic condition, simply by dropping them from an airplane. Additionally, the information has the potential to remain for a longer period of time in the population than a radio broadcast because the recipient has a physical copy. But there are also significant disadvantages associated with this method of dissemination. Though it is easy to get a leaflet into the hands of almost any target population, the individual recipients must be able to read what is printed on it or have it read to them. This greatly increases the chance that the leaflet will be torn up and discarded due to the lack of understanding or possible misinformation concerning the nature of the printed material. In many operations, such as Enduring Freedom in Afghanistan, a great number of individuals who received the leaflet destroyed it because they were illiterate. Though the leaflet was received the message content was not.

A more efficient dissemination of information in these situations would combine the best attributes of both of these methods. Namely, an audio message that could be cheaply distributed to a target population, and that did not require a receiver, would greatly increase the efficiency of these operations.

An area of prior art that disseminates information cheaply without a receiver is that of audio greeting and advertising cards. These cards play a prerecorded audio message or segment of music from an embedded audio circuit when the card is opened. They are typically given to single individuals of a population in response to some special occasion, and are intended to be kept for a period of time and discarded. The design of the cards is such that they will quickly biodegrade in a landfill. These cards are not, however, suitable for the purpose of this invention. It is questionable that greeting cards would even be considered as prior art, because one of ordinary skill in the art of disseminating propaganda would not associate a greeting card as something related to the issue of air dropping leaflets from the air in an open, adverse environment. Their design would not allow them to drop from a great height without a high risk of compromising the audio information. Also, any cards that did survive the airdrop intact would be exposed to rain, snow and sun, thus quickly destroying the audio circuits and degrading the paper material they are printed on, rendering them useless. It is even questionable that the ordinary artisan would mentally connect the field of friendly greeting cards to dissemination of information across enemy lines.

OBJECTS AND SUMMARY OF THE INVENTION

It is an object of the present invention to provide a method for the dissemination of audio information via an airdrop in a hostile environment to individuals of a target population lacking in literacy.

It is another object of the present invention to provide a method for the dissemination of audio information that will, because of its novelty, cause further penetration and dissemination of the information into the hostile population.

Another object of the present invention is to provide a method that will allow the disseminated audio information to remain in the hostile population for longer periods of time, due to the durability and novelty of the carrier of the audio information.

It is yet another object of this invention to provide a method that will increase the retention of the information in a literate individual through the use of a combination of text and audio.

The present invention concerns a method for the dissemination of audio information in a hostile environment via an airdrop to mainly illiterate populations in a target area by means of a leaflet containing audio circuitry (FIG. 1). In the first step (1) of the method the hostile target population is identified and the desired content of the audio information is selected. An audio leaflet is manufactured in the second step (2). A plurality of leaflets may be manufactured prior to step (1) and stored for subsequent use. The leaflet can be a flat sheet or folded, and is constructed of a hardened material designed to withstand an impact with the ground following an airdrop. This hardening process will also function to make the leaflet waterproof, and to protect it from whatever elements it will encounter in the target area. Printed material and pictures corresponding to the audio information can also be printed on the leaflet. A memory chip capable of storing at least one minute of audio information is then incorporated into an audio playback circuit, with an associated power supply, switch and speaker to play the audio information. The switch will activate the audio circuit when the leaflet is opened, when a button is pressed or when it is picked up, by means of a grounding circuit across the recipient's skin.

The desired content of the audio information is then recorded into a recording device in a language that will be understood by the recipient, preferably spoken by an individual that will be recognized as a member of the target population. The message is intended to be a short expression of information. The recording of the audio information can take place in the field by means of a portable recording device or in a manufacturing setting. In the field setting, the audio information is recorded to the portable recording device and then transferred to the plurality of leaflets in an automated process. A stack of leaflets would be placed in a receptacle on the portable recording device and sequentially programmed with the audio information. The portable recorder would also program single leaflets with a more personalized message. In the manufacturing setting the audio information is recorded and then transferred to the memory chip either before the chip is inserted into the leaflet or after the leaflet is fully constructed.

The final steps of the method concern leaflet distribution. A specific target population is identified and the leaflets are airdropped into that area (6). The audio information is subsequently played when activated by a recipient from the target population, and the message is received irrespective of the individual's literacy. Because of the durability and novelty of the leaflet, it is likely to be repeatedly played and demonstrated to others in the population, thus causing a general retention and further dissemination of the audio information. In addition, the combination of text and audio will increase the retention of the information in an individual.

Additional features and advantages of the invention will be apparent from the detailed description which follows, taken in conjunction with the accompanying drawings, which together illustrate, by way of example, features of the invention.

DETAILED DESCRIPTION

Figure 1:
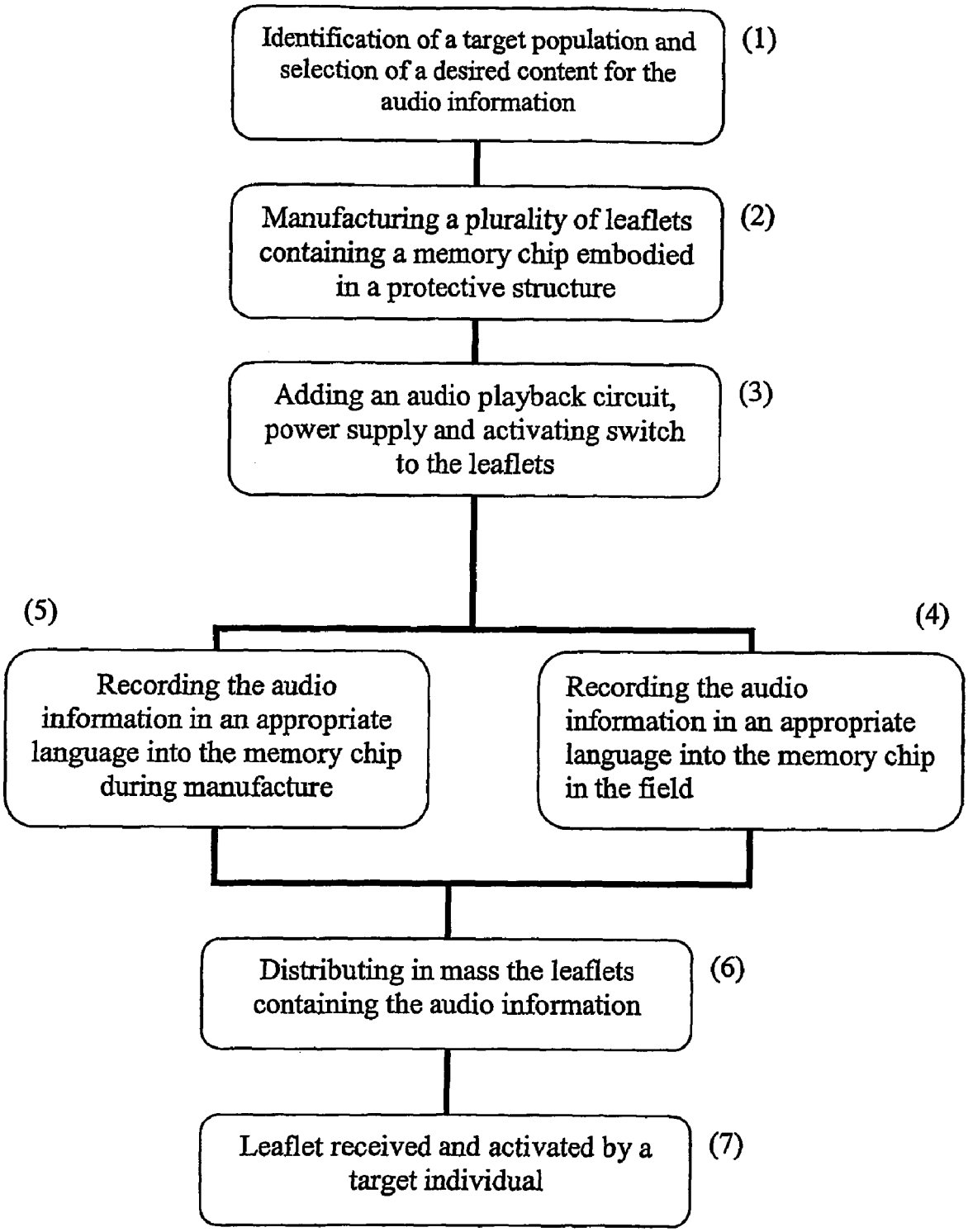
FIG. 1 is a representative description of the steps comprising the method according to the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As shown in FIG. 1, this invention is a method for the repeated dissemination of audio information in mass to a specific, often hostile and illiterate, target population by an airdrop of leaflets. In the first step (1) the target population is identified and the content of the audio information is determined. This may consist of an examination of various key locations of military strategy, where an alteration of the mental state of the target population would increase the chances for the success of the operation. The content of the message would then be dependent on the nature of the target population and the desired change in mental state.

A plurality of leaflets is manufactured in the next step (2). The leaflets are embodied in a protective structure to protect them from water and other elements of nature. This may be accomplished by any method that hardens or plasticizes the leaflet material to provide a durable, waterproof finish. The protective structure will also enable the leaflet to withstand an impact with the ground in response to the airdrop. Audio circuitry is placed within the leaflet (3) comprising a playback circuit, a memory chip, an activating switch and a power source for playing the contents of the memory chip.

In the next step (4, 5) the selected audio content is recorded in the language of the target population to a recording device. The efficiency of the change in mental state would be enhanced by recording the audio information from an individual speaking the local dialect and who would sound like a member of the target population. Additionally, the preferred embodiment of audio information is intended to be a short expression not exceeding 3 minutes in duration. In a manufacturing setting (5), the recorded information can be transferred to the memory chip before it is inserted into the leaflet or after complete assembly of the leaflet. Situations arise, however, when a selection of suitable audio information content is not available in advance. In these cases, the audio information is recorded in the field (4) by means of a portable recording device, which then transfers this recorded audio information to the memory chip in the fully constructed leaflet through inductive or electromechanical means. Once the audio information is recorded into the portable recording device, an automated process transfers the audio information to the plurality of leaflets. This would not, however, preclude the creation of single leaflets with more personalized messages. Also, it is contemplated that multiple versions of the same message recorded in different languages may be contained in the same leaflet.

The next step of the method (6) consists of distributing the leaflets containing the recorded audio information by an airdrop to the target population. The term "airdrop" includes any means by which the leaflets fall through the open air. This would encompass any type of passive release from a height, such as from an airplane or helicopter, a bomb or artillery shell containing leaflets, or release from a train, truck or other mobile carrier. The protective structure will allow the leaflet to impact the ground without damaging it or the enclosed audio circuitry, and will protect it from the elements. In the final step (7) the leaflet is received by an individual of the target population. When the individual opens or otherwise activates the leaflet, the audio information is played and the message is received, irrespective of the literacy of the recipient. The durability of the leaflet will enhance the length of time that the audio information will be available to the population, because it cannot be easily torn up or destroyed. The leaflet will also be played to other individuals in the target population to demonstrate its novelty, thus facilitating further dissemination of the audio information irrespective of the content. Also, by printing a text copy of the audio information on the leaflet, individual retention of the information will be increased.

Figure 2:
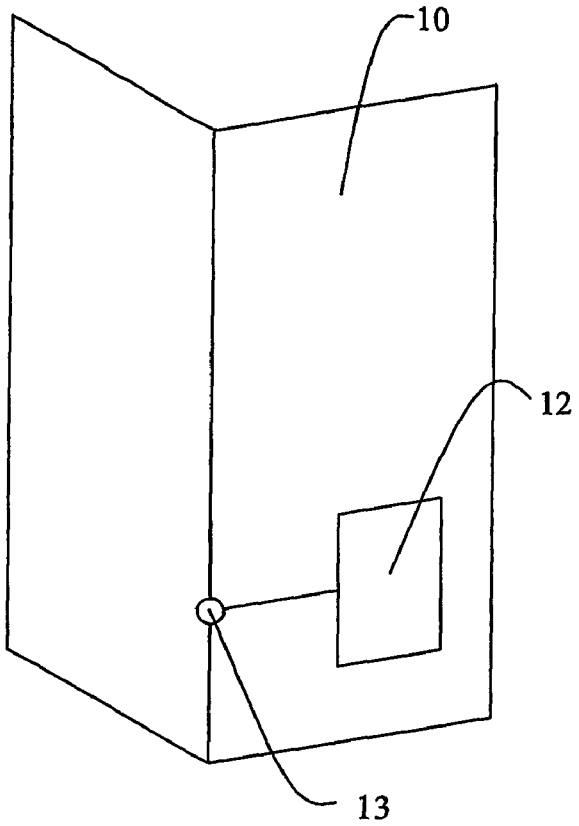
FIG. 2 is a frontal view of a folded leaflet according to the present invention.
Figure 3:
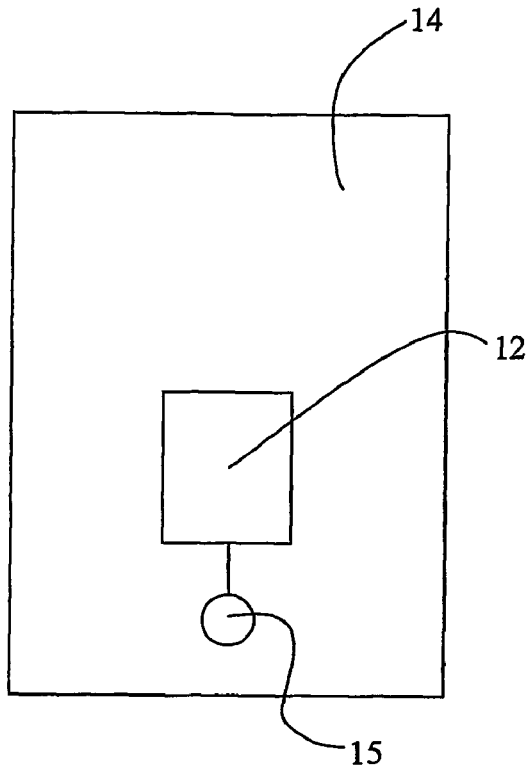
FIG. 3 is a frontal view of flat leaflet according to the present invention.

FIG. 2 shows a leaflet that is folded (10) with the audio circuit (12) being activated by the closing of a switch (13) when the card is unfolded. FIG. 3 shows a leaflet that is flat (14). In this case the audio circuit (12) would be activated by a switch (15) that is clearly marked on the leaflet in the language of the target population. The switch (15) could be activated by pressing or by a grounding circuit across the recipient individual's skin. Other mechanisms for activating the circuit will be apparent to those skilled in the art.

By way of example, the invention could be described as a method for repeated dissemination of audio information in mass by means of an airdrop to an identifiable target population lacking in literacy, comprising the steps of: (1) identifying the target population and selecting a desired content for the audio information; (2) manufacturing a plurality of leaflets containing a memory chip; (3) recording the audio information into a recording device in a language understood by the target population; (4) transferring the recorded audio information from the recording device to the memory chip by any means such as induction or electromechanical contact; and (5) distributing in mass the leaflets containing the recorded audio information to the target population by means of the airdrop. The manufacturing step comprises embodying the leaflets in a protective structure that is resistant to water and other elements of nature, and is capable of withstanding an impact with the ground in response to the airdrop. A playback circuit, the memory chip, activating switch and a power source for playing the recorded audio information is placed within the leaflet. The audio information is intended to be a short expression of information. A text copy of the recorded audio information can be printed on the leaflet. The distributing step comprises: (1) distributing the leaflets containing the recorded audio information to the target population by means of the airdrop; (2) receiving the leaflet by an individual of the target population; and (3) playing of the recorded audio information due to an action by the individual of the target population. An airdrop includes any intentional means whereby the leaflets fall through open air. The action applied by the individual of the target population could be by unfolding the leaflet, by pressing a button or a grounding contact across the individual's skin.

As another example, the invention could be described as the method above wherein the audio information is recorded to the leaflet in a field setting with a portable recorder. The audio information is first recorded into the portable recorder. The recorded audio information is then transferred to the leaflet by the portable recorder. The recorded audio information can be transferred automatically to the plurality of leaflets in succession, or to a single leaflet.

As yet another example, the invention could be described as the method above wherein the audio information is recorded to the plurality of leaflets in a manufacturing setting by an automated means.

As still another example, the invention could be described as a folded or flat audio leaflet designed to play an audio message comprising a leaflet embodied in a protective structure capable of surviving an impact resulting from and airdrop and extended exposure to adverse elements of nature for at least three days. The protective structure is comprised of a hardened material that is resistant to water and other elements of nature, and is capable of withstanding an impact with the ground in response to the airdrop. A text copy of the audio message can be printed on the leaflet. The audio leaflet further comprises a memory circuit contained within the leaflet capable of storing at least one audio message, a lightweight speaker, a power source and an activating switch coupled to the memory circuit, and an audio playback circuit coupled to the memory circuit to play the audio message from the lightweight speaker. The audio leaflet is configured such that the audio message can be recorded into the memory circuit by means of induction, electromechanical contact, or any other means familiar to one skilled in the art. The audio message can be recorded into the memory chip in a manufacturing setting or in a field setting by means of an automated portable recording device. The activating switch can be a switch that activates when the leaflet is unfolded, when the switch is pressed or when the leaflet it touched, by means of a grounding contact across the recipient's skin.

Figure 4:
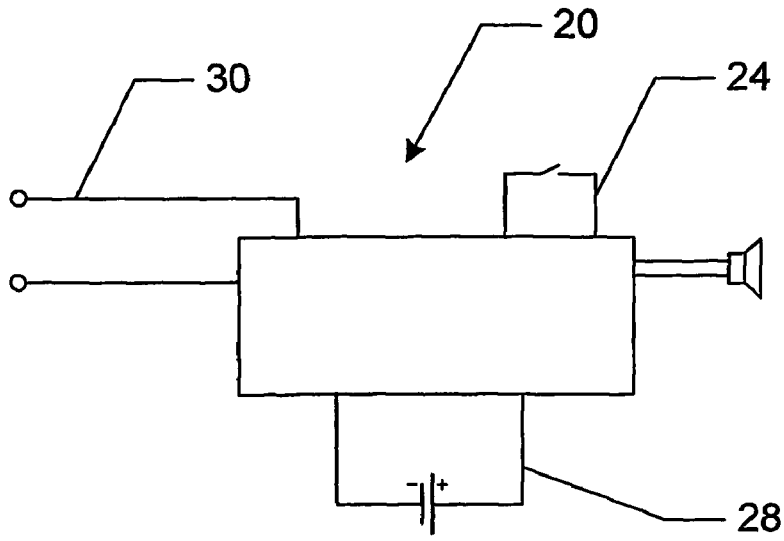
FIG. 4 is a diagrammatic view of audio circuitry within the audio leaflet according to the present invention.

FIG. 4 shows an electrical diagram of one example embodiment of the audio circuitry 20 of an audio leaflet. This embodiment comprises a playback chip 22, an activating switch 24, a speaker 26, a battery 28, an audio input 30, and a 12V input 32. The playback chip may be any audio chip that can receive an audio signal, store the audio signal, and subsequently play the audio signal via a small speaker. One example of such a chip includes, but is not limited to, the ISD1810 Chipcorder by ISD. Other electronic components are associated with the playback chip 22 that are not shown in FIG. 4, but that would be appreciated by one skilled in the art.

It should also be noted that situations may arise where messages may need to be sent securely between individuals. In these cases, it is contemplated that an audio leaflet may be constructed with a plurality of security switches. When the leaflet is being encoded with the audio message, a combination may be encoded into the audio leaflet that is associated with the plurality of security switches. When the leaflet is received by the recipient, the audio message may only be unlocked and played by pressing the correct combination of security switches. The combination may be set before or after the card is programmed.

Figure 5:
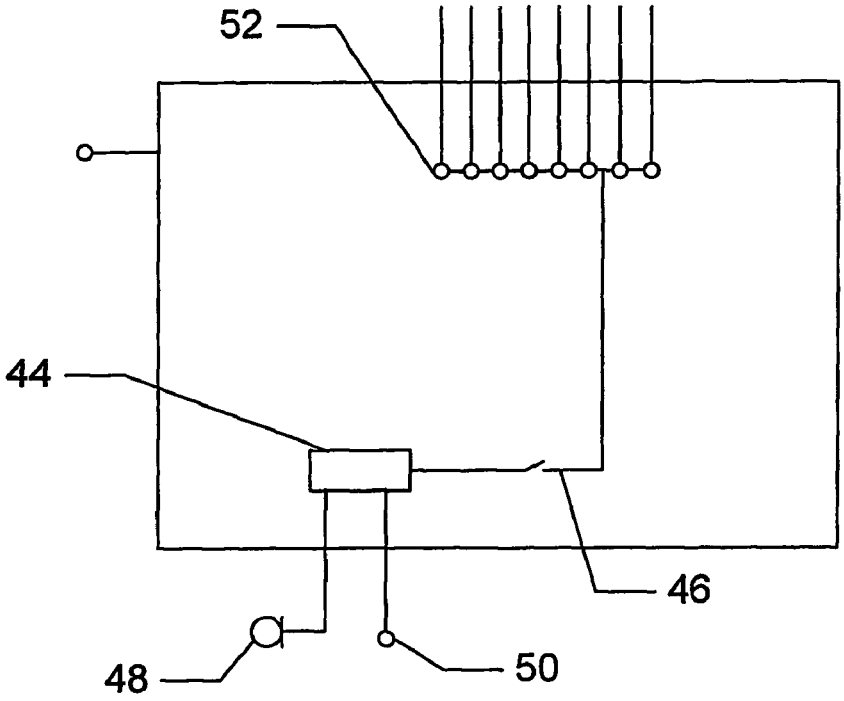
FIG. 5 is a diagrammatic view of audio circuitry within the recording device according to the present invention.

FIG. 5 shows an electrical diagram of one example embodiment of the recording device audio circuitry 40. This embodiment may include a recording/playback chip 42. This chip may be of any design that allows the recording of an audio message, the storage of that audio message, followed by the programming of that audio message into one or a plurality of audio leaflets. An example of such a chip includes, but is not limited to, the ISD1416 and the ISD1420 Chipcorder by ISD. This embodiment also includes a storage array 44 into which the audio message is stored after being received by the chip from a microphone 48 or other device attached via an auxiliary jack 50. Upon activation of a record switch 46, the audio message is transferred to one or a plurality of audio leaflets by means of an address buffer array 52. The recording device audio circuitry 40 may be powered by an external 12V AC or DC source 54. Other electronic components are associated with the recording/playback chip 42 that are not shown in FIG. 5, but that would be appreciated by one skilled in the art.

Figure 6:
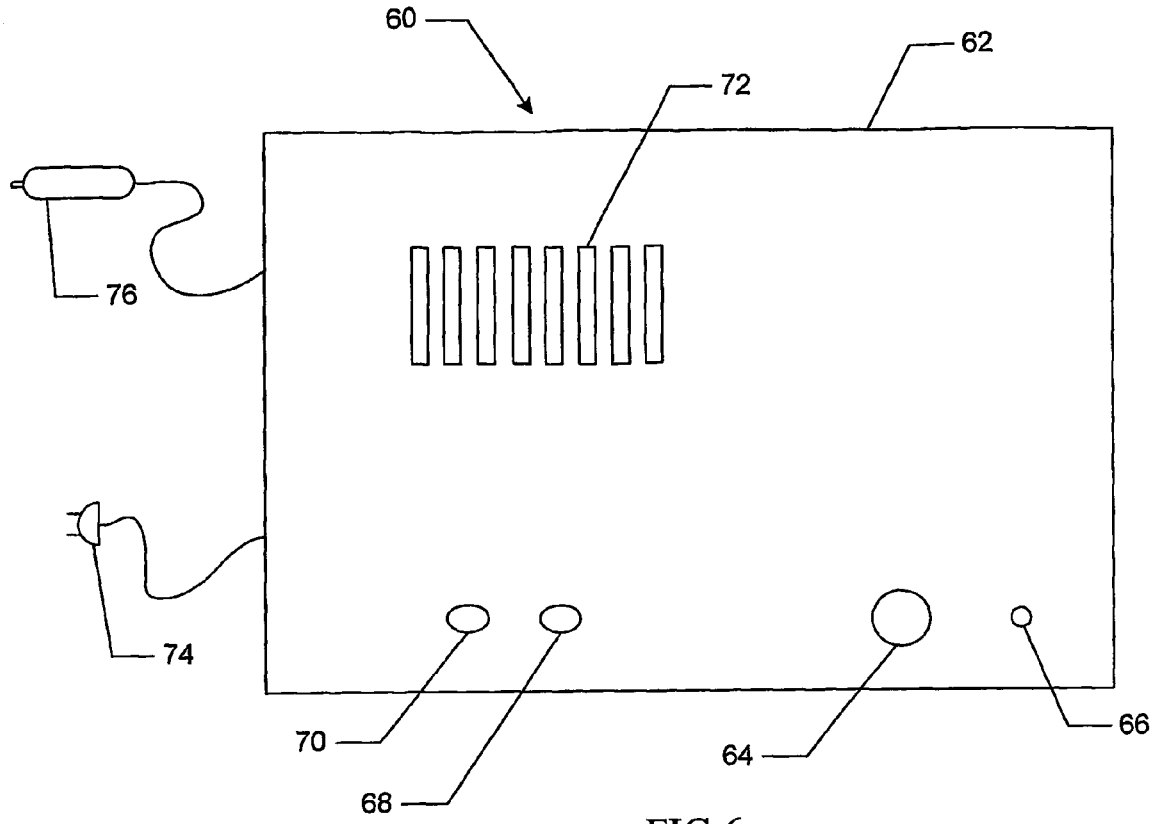
FIG. 6 is a diagrammatic view of the exterior of the recording device according to the present invention.

FIG. 6 shows a diagrammatic view of an example embodiment of a portable recording device 60. The device may include a housing 62. This housing 62 may be rugged and waterproof to withstand extreme field conditions. The recording device may include a microphone 64 coupled to the housing, and it may also include an auxiliary input 66 for coupling to an external microphone or other audio input. Additionally, the unit may be operated with AC power 74, or from DC power 76. The AC power 74 input may include a universal adapter for operation in countries with diverse power requirements. One example of a DC power source may include a vehicle DC power adapter.

The recording device 60 may also include a record message button 68. This button would be depressed while recording an audio message to activate the recording mode of the recording/playback chip 42. This action would cause the audio message to be stored in the storage array 44. Upon releasing the record message button 68, recording would cease. Audio leaflets may be inserted into one or a plurality of connector slots 72. Upon activation of a leaflet program button 70, the audio message is transferred to the audio leaflets. This transfer may occur by induction, electromechanical contact or any other means known to one skilled in the art. The audio message may remain in the storage array 44 until the record message button 68 is activated, allowing multiple batches of audio leaflets to be programmed with the same audio message.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variation in size, materials, shape, form, function and manner of operation, assembly and use can be made without departing from the principles and concepts of the invention as set forth herein.

What is claimed is:

1. A method for repeated dissemination of audio information in mass by means of an airdrop to an identifiable target population lacking in literacy, comprising the following steps:

a) identifying the target population and selecting a desired content for the audio information;

b) manufacturing a plurality of leaflets containing a memory chip;

c) recording the audio information into a recording device in a language understood by the target population;

d) transferring the recorded audio information from the recording device to the memory chip; and d) distributing in mass the leaflets containing the recorded audio information to the target population by means of the airdrop.

2. The method as in claim 1 wherein the manufacture of the leaflets comprises the following steps:

a) manufacturing the leaflets such that the leaflets are embodied in a protective structure that is resistant to water and other elements of nature, and is capable of withstanding an impact with the ground in response to the airdrop; and b) placing within the leaflet a playback circuit, the memory chip, activating switch and a power source for playing the recorded audio information.

3. The method as in claim 1 wherein a text copy of the recorded audio information is printed on the leaflet.

4. The method as in claim 1 wherein the recorded audio information does not exceed 3 minutes in length.

5. The method as in claim 1 wherein:

a) the recording device is portable;

b) the recording of the audio information occurs in a field setting; and c) the transfer of the recorded audio information to the memory chip in the leaflet is by means of the portable recording device.

6. The method as in claim 1 wherein the transfer of the recorded audio information to the memory chip in the leaflet is by a means selected from the group consisting of induction and electromechanical contact.

7. The method as in claim 1 wherein the audio information is transferred to the plurality of leaflets in succession by an automated means.

8. The method as in claim 1 wherein the audio information is transferred to a single leaflet.

9. The method as in claim 1 wherein the distributing of the leaflets further comprises the following steps:

a) distributing the leaflets containing the recorded audio information to the target population by means of the airdrop;

b) receiving the leaflet by an individual of the target population; and c) playing of the recorded audio information due to an action by the individual of the target population.

10. The method as in claim 9 wherein the means of the airdrop includes any intentional means whereby the leaflets fall through open air.

11. The method as in claim 9 wherein the action applied by the individual of the target population is an unfolding of the leaflet.

12. The method as in claim 9 wherein the action applied by the individual of the target population is a pressing of the activating switch.

13. The method as in claim 9 wherein the action applied by the individual of the target population is a picking up of the leaflet causing an activation of the playback circuit by means of a grounding contact across the individual's skin.

14. The method as in claim 1 wherein:

a) the recording of the audio information to the recording device occurs in a manufacturing setting; and b) the recorded audio information is transferred from the recording device to the memory chips of the plurality of leaflets in succession by an automated means.

15. An audio leaflet designed to play an audio message comprising:

a) a leaflet embodied in a protective structure capable of surviving (i) an impact resulting from and airdrop and (ii) extended exposure to adverse elements of nature for at least three days;

b) a memory circuit contained within the leaflet capable of storing at least one audio message;

c) a lightweight speaker, a power source and an activating switch coupled to the memory circuit; and d) an audio playback circuit coupled to the memory circuit to play the at least one audio message from the lightweight speaker.

16. The audio leaflet as in claim 15, wherein the protective structure is comprised of a hardened material that is resistant to water and other elements of nature, and is capable of withstanding an impact with the ground in response to the airdrop.

17. The audio leaflet as in claim 15 wherein text corresponding to the audio message is printed on the leaflet.

18. The audio leaflet as in claim 15 wherein the audio message is configured to be recorded into the memory circuit by means of a portable recording device.

19. The audio leaflet as in claim 15 wherein the memory circuit is configured to receive the audio information by a means selected from the group consisting of induction and electromechanical contact.

20. The audio leaflet as in claim 15 wherein the memory circuit is configured to be recorded by an automated means in succession.

21. The audio leaflet as in claim 15 wherein:

a) the leaflet is folded; and b) the switch is activated by opening the leaflet.

22. The audio leaflet as in claim 15 wherein:

a) the leaflet is flat; and b) the switch is activated by pressing the switch.

23. The audio leaflet as in claim 15 wherein:

a) the leaflet is flat; and b) the switch is activated by touching an electrical grounding circuit.

24. The audio leaflet as in claim 15 wherein the switch is a plurality of security switches, wherein the plurality of security switches requires activation in a predetermined order to play the audio message.

* * * * *